US009739097B2

(12) United States Patent
Zhang et al.

(10) Patent No.: US 9,739,097 B2
(45) Date of Patent: Aug. 22, 2017

(54) POLYCRYSTALLINE DIAMOND COMPACT CUTTERS WITH CONIC SHAPED END

(75) Inventors: Youhe Zhang, Spring, TX (US); Yuelin Shen, Spring, TX (US); Yuri Burhan, Spring, TX (US); Jibin Shi, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 1337 days.

(21) Appl. No.: 13/456,352

(22) Filed: Apr. 26, 2012

(65) Prior Publication Data

US 2012/0273280 A1 Nov. 1, 2012

Related U.S. Application Data

(60) Provisional application No. 61/479,183, filed on Apr. 26, 2011.

(51) Int. Cl.
*E21B 10/573* (2006.01)

(52) U.S. Cl.
CPC ..... *E21B 10/573* (2013.01)

(58) Field of Classification Search
CPC ..... E21B 10/46; E21B 10/62; E21B 10/42; E21B 10/55; E21B 10/567
USPC ..... 175/428, 432, 413, 412, 352, 384
See application file for complete search history.

(56) References Cited

U.S. PATENT DOCUMENTS 3,442,342 A 5/1969 Cunningham et al.
3,581,835 A 6/1971 Stebley
3,788,409 A 1/1974 Curington
3,970,158 A 7/1976 Black et al.
4,047,583 A 9/1977 Dyer
4,104,344 A 8/1978 Pope et al.
4,108,260 A 8/1978 Bozarth
4,181,187 A 1/1980 Lumen
4,288,248 A 9/1981 Bovenkerk et al.
4,323,130 A 4/1982 Dennis
4,334,585 A 6/1982 Upton
(Continued)

FOREIGN PATENT DOCUMENTS

CN 2526491 Y 12/2002
CN 101157149 A 4/2008
(Continued)

OTHER PUBLICATIONS

Clayton, et al., "New Bit Design, Cutter Technology Extend PDC Applications to Hard Rock Drilling", SPE 91840—SPE/IADC Drilling Conference, Amsterdam, Netherlands, Feb. 23-25, 2005, 9 pages.

(Continued)

*Primary Examiner* — David Bagnell
*Assistant Examiner* — Ronald Runyan

(57) ABSTRACT

A cutting element may have a substrate; and an ultrahard material layer having a substantially planar upper surface disposed on an upper surface of the substrate; wherein at least a portion of the side surface between the upper surface of the substrate and a lower end of the substrate form at least one conic surface, wherein the at least one conic surface extends a height relative to the total height of the substrate and ultrahard material layer ranging from about 1:10 to 9:10, and wherein the substrate comprises a substantially planar lower surface. The cutting elements may also be rotatable cutting elements at least partially surrounded by outer support elements.

22 Claims, 10 Drawing Sheets

(56) References Cited

U.S. PATENT DOCUMENTS

| | | | | |
|---|---|---|---|---|
| 4,381,825 | A | 5/1983 | Radtke | |
| 4,396,077 | A | 8/1983 | Radtke | |
| 4,442,909 | A | 4/1984 | Radtke | |
| 4,478,297 | A | 10/1984 | Radtke | |
| 4,494,618 | A | 1/1985 | Radtke | |
| 4,505,342 | A | 3/1985 | Barr et al. | |
| 4,529,048 | A | 7/1985 | Hall | |
| 4,570,725 | A | 2/1986 | Matthias et al. | |
| 4,593,776 | A | 6/1986 | Salesky et al. | |
| 4,597,456 | A | 7/1986 | Ecer | |
| 4,604,106 | A | 8/1986 | Hall | |
| 4,605,157 | A | 8/1986 | Barr et al. | |
| 4,632,196 | A | 12/1986 | Dennis | |
| 4,722,405 | A | 2/1988 | Langford, Jr. | |
| 4,724,913 | A | 2/1988 | Morris | |
| 4,751,972 | A | 6/1988 | Jones et al. | |
| 4,767,050 | A | 8/1988 | Flood et al. | |
| 4,811,801 | A | 3/1989 | Salesky et al. | |
| 4,821,819 | A | 4/1989 | Whysong | |
| 4,832,139 | A | 5/1989 | Minikus et al. | |
| 4,887,493 | A | 12/1989 | Drake | |
| 4,981,184 | A | 1/1991 | Knowlton et al. | |
| 5,025,874 | A | 6/1991 | Barr et al. | |
| 5,060,739 | A | 10/1991 | Griffin | |
| 5,061,293 | A | 10/1991 | Barr et al. | |
| 5,119,714 | A | 6/1992 | Scott et al. | |
| 5,127,923 | A | 7/1992 | Bunting et al. | |
| 5,159,857 | A | 11/1992 | Jurewicz | |
| 5,161,627 | A | 11/1992 | Burkett | |
| 5,172,779 | A | 12/1992 | Siracki et al. | |
| 5,285,859 | A | 2/1994 | Tibbitts | |
| 5,287,936 | A | 2/1994 | Grimes et al. | |
| 5,323,865 | A | 6/1994 | Isbell et al. | |
| 5,333,699 | A | 8/1994 | Thigpen et al. | |
| 5,351,768 | A | 10/1994 | Scott et al. | |
| 5,373,900 | A * | 12/1994 | Lynde | B23B 5/16 166/297 |
| 5,379,853 | A | 1/1995 | Lockwood et al. | |
| 5,415,244 | A | 5/1995 | Portwood | |
| 5,431,239 | A | 7/1995 | Tibbitts et al. | |
| 5,437,343 | A * | 8/1995 | Cooley | E21B 10/5673 175/431 |
| 5,449,048 | A | 9/1995 | Thigpen et al. | |
| 5,460,233 | A | 10/1995 | Meany et al. | |
| 5,467,669 | A | 11/1995 | Stroud | |
| 5,469,927 | A | 11/1995 | Griffin | |
| 5,484,191 | A | 1/1996 | Sollami | |
| 5,535,839 | A | 7/1996 | Brady | |
| 5,649,604 | A | 7/1997 | Fuller et al. | |
| 5,678,645 | A | 10/1997 | Tibbitts et al. | |
| 5,697,462 | A | 12/1997 | Grimes et al. | |
| 5,709,278 | A | 1/1998 | Crawford | |
| 5,722,497 | A | 3/1998 | Gum et al. | |
| 5,740,874 | A | 4/1998 | Matthias | |
| 5,752,573 | A | 5/1998 | Scott et al. | |
| 5,803,196 | A | 9/1998 | Fielder | |
| 5,881,828 | A | 3/1999 | Fischer et al. | |
| 5,887,580 | A | 3/1999 | Eyre | |
| 5,979,577 | A | 11/1999 | Fielder | |
| 5,979,578 | A * | 11/1999 | Packer | E21B 10/567 175/432 |
| 5,979,579 | A | 11/1999 | Jurewicz | |
| 6,029,759 | A | 2/2000 | Sue et al. | |
| 6,065,552 | A | 5/2000 | Scott et al. | |
| 6,116,359 | A | 9/2000 | Prejean | |
| 6,142,250 | A | 11/2000 | Griffin et al. | |
| 6,145,605 | A | 11/2000 | Karlsson | |
| 6,199,645 | B1 | 3/2001 | Anderson et al. | |
| 6,220,376 | B1 | 4/2001 | Lundell | |
| 6,227,318 | B1 | 5/2001 | Siracki | |
| 6,241,035 | B1 | 6/2001 | Portwood | |
| 6,244,365 | B1 | 6/2001 | Southland | |
| 6,253,864 | B1 | 7/2001 | Hall | |
| 6,290,008 | B1 | 9/2001 | Portwood et al. | |
| 6,302,224 | B1 | 10/2001 | Sherwood, Jr. | |
| 6,330,924 | B1 | 12/2001 | Hall | |
| 6,371,225 | B1 | 4/2002 | Overstreet et al. | |
| 6,394,199 | B1 | 5/2002 | Skyles et al. | |
| 6,443,246 | B1 | 9/2002 | Pessier et al. | |
| 6,488,106 | B1 | 12/2002 | Dourfaye | |
| 6,604,588 | B2 | 8/2003 | Eyre et al. | |
| 7,416,145 | B2 | 8/2008 | Hall et al. | |
| 7,559,695 | B2 | 7/2009 | Sexton et al. | |
| 7,703,559 | B2 | 4/2010 | Shen et al. | |
| 2002/0000336 | A1 | 1/2002 | Claesson et al. | |
| 2002/0084112 | A1 | 7/2002 | Hall et al. | |
| 2002/0100620 | A1 | 8/2002 | Singh et al. | |
| 2002/0108790 | A1 | 8/2002 | Eyre et al. | |
| 2004/0026983 | A1 | 2/2004 | McAlvain | |
| 2004/0065484 | A1 | 4/2004 | McAlvain | |
| 2004/0094334 | A1 | 5/2004 | Singh | |
| 2004/0108145 | A1 | 6/2004 | Siracki | |
| 2004/0149493 | A1 | 8/2004 | McDonough | |
| 2005/0211474 | A1 | 9/2005 | Nguyen et al. | |
| 2005/0257963 | A1 | 11/2005 | Tucker et al. | |
| 2005/0263327 | A1 | 12/2005 | Meiners et al. | |
| 2006/0157286 | A1 | 7/2006 | Pope | |
| 2007/0000699 | A1 | 1/2007 | Viswanadham et al. | |
| 2007/0084640 | A1 | 4/2007 | Singh | |
| 2007/0125579 | A1 | 6/2007 | Chen et al. | |
| 2007/0151769 | A1 | 7/2007 | Slutz et al. | |
| 2007/0278015 | A1 | 12/2007 | Boudrare et al. | |
| 2008/0035384 | A1 | 2/2008 | Simmons et al. | |
| 2008/0041993 | A1 | 2/2008 | Hall et al. | |
| 2008/0053710 | A1 | 3/2008 | Moss | |
| 2008/0121746 | A1 | 5/2008 | Hall et al. | |
| 2008/0156542 | A1 | 7/2008 | Baker et al. | |
| 2008/0156544 | A1 | 7/2008 | Singh et al. | |
| 2008/0164069 | A1 | 7/2008 | McDonough et al. | |
| 2008/0190666 | A1 | 8/2008 | Gatell | |
| 2008/0264696 | A1 | 10/2008 | Dourfaye et al. | |
| 2008/0308320 | A1 | 12/2008 | Kolachalam | |
| 2009/0000827 | A1 | 1/2009 | Bird et al. | |
| 2009/0020339 | A1 | 1/2009 | Sherwood, Jr. | |
| 2009/0178856 | A1 | 7/2009 | Singh et al. | |
| 2009/0229887 | A1 | 9/2009 | Tedeschi | |
| 2010/0108403 | A1 | 5/2010 | Keshavan | |
| 2010/0126775 | A1 | 5/2010 | Crawford et al. | |
| 2010/0219001 | A1 | 9/2010 | Shen et al. | |
| 2010/0243336 | A1* | 9/2010 | Dourfaye | C22C 26/00 175/434 |
| 2011/0031031 | A1* | 2/2011 | Vempati | C22C 26/00 175/428 |
| 2011/0297454 | A1 | 12/2011 | Shen et al. | |
| 2012/0273281 | A1 | 11/2012 | Burhan et al. | |
| 2013/0199857 | A1 | 8/2013 | Schwefe et al. | |

FOREIGN PATENT DOCUMENTS

| | | | |
|---|---|---|---|
| EP | 219959 | A2 | 4/1987 |
| EP | 291314 | A2 | 11/1988 |
| EP | 353214 | A2 | 1/1990 |
| EP | 601840 | A1 | 6/1994 |
| EP | 579662 | B1 | 12/1996 |
| EP | 916804 | A1 | 5/1999 |
| GB | 2216577 | A | 10/1989 |
| GB | 2240797 | A | 8/1991 |
| GB | 2275690 | A | 9/1994 |
| WO | 2008112262 | A1 | 9/2008 |
| WO | 2009023706 | A1 | 2/2009 |

OTHER PUBLICATIONS

Feenstra, R. , "Status of Polycrystalline-Diamond-Compact Bits: Part I Development", Journal of Petroleum Technology, vol. 40 (6), Jun. 1988, pp. 675-684.

Kerr, et al., "PDC Drill Bit Design and Field Application Evolution", Journal of Petroleum Technology, vol. 40 (3), Mar. 1988, pp. 327-332.

Keshavan, et al., "Diamond-Enhanced Insert: New Compositions and Shapes for Drilling Soft-to-Hard Formations", SPE 25737—

(56) References Cited

OTHER PUBLICATIONS

SPE/IADC Drilling Conference, Amsterdam, Netherlands, Feb. 22-25, 1993, 15 pages.
Sinor, et al., "The Effect of PDC Cutter Density, Back Rake, Size, and Speed on Performance", SPE 39306—IADC/SPE Drilling Conference, Dallas, Texas, Mar. 3-6, 1998, 9 pages.
Tran, Mark , "New PDC bit designs continue to improve", World Oil, vol. 229 (11), 2008, pp. 97-106.
International Search Report and Written Opinion of PCT Application No. PCT/US2012/035087 dated Jan. 31, 2013.
Translation of Chinese Office Action issued in 201280020271.2 on Oct. 10, 2014, 14 pages.

* cited by examiner

POLYCRYSTALLINE DIAMOND COMPACT CUTTERS WITH CONIC SHAPED END

CROSS-REFERENCE TO RELATED APPLICATIONS

This applications claims benefit of U.S. Patent Application No. 61/479,183, filed on Apr. 26, 2011, the entirety of which is herein incorporated by reference.

BACKGROUND

Various types and shapes of earth boring bits are used in various applications in the earth drilling industry. Earth boring bits have bit bodies which include various features such as a core, blades, and cutter pockets that extend into the bit body or roller cones mounted on a bit body, for example. Depending on the application/formation to be drilled, the appropriate type of drill bit may be selected based on the cutting action type for the bit and its appropriateness for use in the particular formation.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are typically bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In a typical application, a compact of polycrystalline diamond (PDC) (or other ultrahard material) is bonded to a substrate material, which is typically a sintered metal-carbide to form a cutting structure. PDC comprises a polycrystalline mass of diamonds (typically synthetic) that are bonded together to form an integral, tough, high-strength mass or lattice. The resulting PDC structure produces enhanced properties of wear resistance and hardness, making PDC materials extremely useful in aggressive wear and cutting applications where high levels of wear resistance and hardness are desired.

A PDC cutter is conventionally formed by placing a sintered carbide substrate into the container of a press. A mixture of diamond grains or diamond grains and catalyst binder is placed atop the substrate and treated under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn integrally bonded to the substrate. The substrate often comprises a metal-carbide composite material, such as tungsten carbide-cobalt. The deposited diamond layer is often referred to as the "diamond table" or "abrasive layer."

An example of a prior art PDC bit having a plurality of cutters with ultra hard working surfaces is shown in FIG. 1A. The drill bit 100 includes a bit body 110 having a threaded upper pin end 111 and a cutting end 115. The cutting end 114 typically includes a plurality of ribs or blades 120 arranged about the rotational axis (also referred to as the longitudinal or central axis) of the drill bit and extending radially outward from the bit body 110. Cutting elements, or cutters, 150 are embedded in the blades 120 at predetermined angular orientations and radial locations relative to a working surface and with a desired back rake angle and side rake angle against a formation to be drilled.

A plurality of orifices 116 are positioned on the bit body 110 in the areas between the blades 120, which may be referred to as "gaps" or "fluid courses." The orifices 116 are commonly adapted to accept nozzles. The orifices 116 allow drilling fluid to be discharged through the bit in selected directions and at selected rates of flow between the blades 120 for lubricating and cooling the drill bit 100, the blades 120 and the cutters 150. The drilling fluid also cleans and removes the cuttings as the drill bit 100 rotates and penetrates the geological formation. Without proper flow characteristics, insufficient cooling of the cutters 150 may result in cutter failure during drilling operations. The fluid courses are positioned to provide additional flow channels for drilling fluid and to provide a passage for formation cuttings to travel past the drill bit 100 toward the surface of a wellbore (not shown).

Referring to FIG. 1B, a conventional cutting element 150 is shown. A conventional cutting element 150 includes a cemented carbide substrate 152 bonded to an ultrahard material layer 154 at an interface 156.

Cutters are conventionally attached to a drill bit or other downhole tool by a brazing process. In the brazing process, a braze material is positioned between the cutter and the cutter pocket. The material is melted and, upon subsequent solidification, bonds (attaches) the cutter in the cutter pocket. Selection of braze materials depends on their respective melting temperatures, to avoid excessive thermal exposure (and thermal damage) to the diamond layer prior to the bit (and cutter) even being used in a drilling operation. Specifically, alloys suitable for brazing cutting elements with diamond layers thereon have been limited to only a couple of alloys which offer low enough brazing temperatures to avoid damage to the diamond layer and high enough braze strength to retain cutting elements on drill bits.

Cracking (and/or formation of micro-cracks) in the bit body can also occur during the cutter brazing process in the area surrounding the cutter pockets. The formation and propagation of cracks in the matrix body during the drilling process may result in the loss of one or more PDC cutters. A lost cutter may abrade against the bit, causing further accelerated bit damage. FIG. 16 illustrates such cracking that can occur in a bit body using a conventional cutter.

A significant factor in determining the longevity of PDC cutters is the exposure of the cutter to heat. Conventional polycrystalline diamond is stable at temperatures of up to 700-750° C. in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

Exposure to heat (through brazing or through frictional heat generated from the contact of the cutter with the formation) can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. As a cutting element contacts the formation, a wear flat develops and frictional heat is induced. As the cutting element is continued to be used, the wear flat will increase in size and further induce frictional heat. The heat may build-up that may cause failure of the cutting element due to thermal mis-match between diamond and catalyst discussed above. This is particularly true for cutters that are immovably attached to the drill bit, as conventional in the art.

Accordingly, there exists a continuing need to develop ways to extend the life of a cutting element.

SUMMARY OF INVENTION

In one aspect, embodiments disclosed herein relate to a cutting element that includes a substrate; and an ultrahard material layer having a substantially planar upper surface disposed on an upper surface of the substrate; wherein at least a portion of the side surface between the upper surface of the substrate and a lower end of the substrate form at least one conic surface, wherein the at least one conic surface extends a height relative to the total height of the substrate and ultrahard material layer ranging from about 1:10 to 9:10, and wherein the substrate comprises a substantially planar lower surface.

In another aspect, embodiments disclosed herein relate to a cutter assembly that includes an outer support element; and inner rotating cutting element, a portion of which is disposed in the outer support element, where the inner rotating cutting element includes a substrate; and an ultrahard material layer having a substantially planar upper surface disposed on an upper surface of the substrate; wherein at least a portion of the side surface between the upper surface of the substrate and a lower end of the substrate form at least one conic surface, wherein the at least one conic surface extends a height relative to the total height of the substrate and ultrahard material layer ranging from about 1:10 to 9:10, and wherein the substrate comprises a substantially planar lower surface.

In another aspect, embodiments disclosed herein relate to a cutter assembly that includes an outer support element; and an inner rotating cutting element comprising an ultrahard material forming a substantially planar upper surface at its upper end; wherein the inner rotatable cutting element has a smaller diameter than the outer diameter of the inner rotatable cutting element along at least about 10 to 90 percent of the inner rotatable cutting element from a lower end.

In yet another aspect, embodiments disclosed herein relate to a downhole cutting tool that includes a cutting element support structure having at least one cutter pocket formed therein; at least one cutting element disposed within the at least one cutter pocket, where in the at least one cutting element comprises: a substrate; and an ultrahard material layer having a substantially planar upper surface disposed on an upper surface of the substrate; wherein at least a portion of the side surface between the upper surface of the substrate and a lower end of the substrate form at least one conic surface, wherein the at least one conic surface extends a height relative to the total height of the substrate and ultrahard material layer ranging from about 1:10 to 9:10, and wherein the substrate comprises a substantially planar lower surface.

In yet another aspect, embodiments disclosed herein relate to a downhole cutting tool that includes a cutting element support structure having at least one cutter pocket formed therein; at least one rotatable cutting element disposed within the at least one cutter pocket, where in the at least one rotatable cutting element comprises an ultrahard material forming a substantially planar upper surface at its upper end; wherein the inner rotatable cutting element has a smaller diameter than the outer diameter of the inner rotatable cutting element along at least about 10 to 90 percent of the inner rotatable cutting element from a lower end; and at least one retaining element configured to retain the rotatable cutting element in the cutter pocket.

In another aspect, embodiments disclosed herein relate to a cutting element that includes a substrate comprising a substantially planar lower surface; and an ultrahard material layer having a substantially planar upper surface disposed on an upper surface of the substrate; wherein at least a portion of the side surface between the upper surface of the substrate and a lower end of the substrate form at least one conic surface, wherein the at least one conic surface extends toward a longitudinal axis of the cutting element such that a diameter of the substantially planar lower surface relative to a diameter of the ultrahard material layer ranges from about 1:10 to less than 4:5.

In yet another aspect, embodiments disclosed herein relate to a cutter assembly, that includes an outer support element; and an inner rotating cutting element comprising an ultrahard material forming a substantially planar upper surface at its upper end; wherein the inner rotatable cutting element has a substantially planar lower surface; and wherein the substantially planar lower surface of the inner rotatable cutting element is in contact with the outer support element at a diameter relative to the upper surface of the inner rotatable cutting element ranging from about 1:10 to less than 4:5.

In yet another aspect, embodiments disclosed herein relate to a fixed cutter drill bit that includes a bit body; at least one blade extending radially from a center of the bit body; at least one cutter pocket formed in the at least one blade; at least one cutting element or cutter assembly of the above paragraphs disposed within the at least one cutter pocket.

Other aspects and advantages of the invention will be apparent from the following description and the appended claims.

DETAILED DESCRIPTION

In one aspect, embodiments disclosed herein relate to polycrystalline diamond compact cutters having a conic or other shaped end (remote from the cutting surface) and bits or other cutting tools incorporating the same. More particularly, embodiments disclosed herein relate to cutters having a conic or other shaped end (remote from the cutting surface) that may be immovably attached to the bit or tool on which it is being used or it may be retained on the bit or tool in such a manner that it is free to rotate about its longitudinal axis. While much of the prior art on cutting elements concerns the cutting end of the element, the present disclosure is directed to shaping the remote end of the cutting element to improve cutter and bit life.

Figure 2:
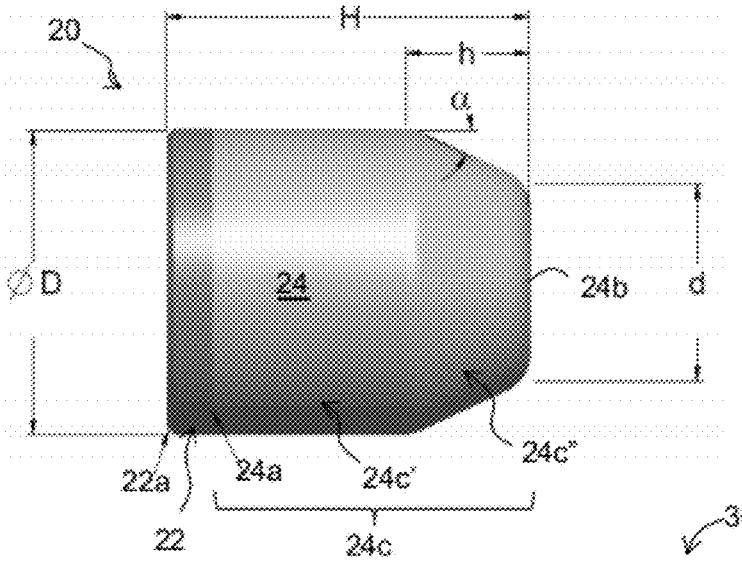
FIG. 2 shows a cutting element according to one embodiment of the present disclosure.

FIG. 2 illustrates a side view of one embodiment of a cutting element according to the present disclosure. As shown in FIG. 2, a cutting element 20 possesses an ultrahard material layer 22 and a substrate 24. Ultrahard material layer 22 is disposed on and interfaces with an upper surface 24*a* of substrate 24. While upper surface 24*a* is illustrated as being planar, it (and the interfacing ultrahard layer) may be non-planar to form any type of non-planar interface as known in the art. An upper surface 22*a* of ultrahard material layer 22 is shown as being substantially planar and is the cutting surface of the cutting element 20 when installed on a bit or other cutting tool. The lowermost surface 24*b* of substrate is also shown as being substantially planar. A side surface 24*c* extends the length of substrate 24 between upper surface 24*a* and lower surface 24*b*. In the embodiment illustrated in FIG. 2, a portion of side surface 24*c* forms a cylindrical surface 24*c*' that extends from upper surface 24*a*, and a portion of side surface 24*c* form a conic surface 24*c*" that extends between cylindrical surface 24*c*' and lower surface 24*b*. In accordance with various embodiments of the present disclosure the conic surface 24*c*" may be of such size that its height h extends along from about 10 to 90 percent of the total height H of the cutting element 20. Other embodiments may use a h ranging from any of a lower limit of any of 0.1H, 0.2H, 0.3H, 0.4H, 0.5H, 0.6H, 0.7H, and 0.8H to an upper limit of any of 0.2H, 0.3H, 0.4H, 0.5H, 0.6H, 0.7H, 0.8H, and 0.9H.

Further, the conic surface 24*c*" extends from an outer radial position towards a longitudinal axis of the cutting element such that the lower surface 24*b* possesses a smaller diameter d than the upper surface 24*a* of the substrate 24 (or largest diameter of the cutting element 20)'s diameter D. In various embodiments, d may range from about D/10 to less than D. Other embodiments may use a d ranging from any of a lower limit of any of D/10, D/5, D/4, D/3, D/2, ⅔(D), ¾(D), ⅘(D) to an upper limit of any of D/5, D/4, D/3, D/2, ⅔(D), ¾(D), ⅘(D), and less than D. Further, conic surface 24*c*" may form an angle α with cylindrical surface 24*c*'. In various embodiments, such angle α may range from about 15 degrees to about 70 degrees. Further, transitions between cylindrical surface 24*c*' and conic surface 24*c*" and/or conic surface 24*c*" and lower surface 24*b* may be radiused for a smooth transition. For example, such transition may be smoothly and continuously curved so as to be free of sharp edges and/or transitions with radii of at least about 0.005 inches, or at least about 0.020 inches in another embodiment, and up to 0.50 inches in yet another embodiment.

Figure 3:
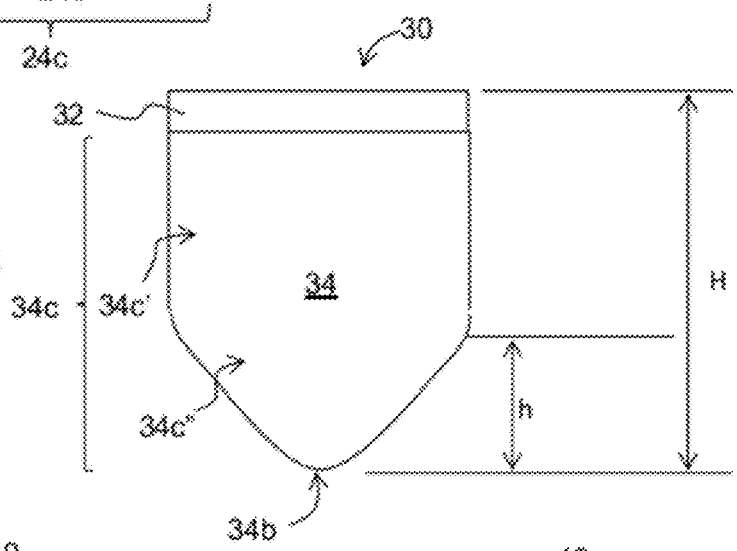
FIG. 3 shows a cutting element according to one embodiment of the present disclosure.

Referring now to FIG. 3, another embodiment of the present disclosure is illustrated. While the embodiment shown above in FIG. 2, shows a substantially planar lower surface 24*b*, the cutting element 30 shown in FIG. 3 has a substrate 34 with a lower end 34*b* that terminates in an apex, i.e., a side surface 34*c* of substrate 34 is a paraboloidal surface 34*c*". Such cutting element 30 may be particularly used as a rotatable cutting element, i.e., as a part of a cutter assembly, so that the element 30 is free to rotate within a separate outer sleeve or support element or within a cutter pocket. The paraboloidal surface 34*c*" may extend between cylindrical surface 34*c*" and apex 34*b* a height h that is between 10 and 90 percent of the total height H of cutting element 30. Other embodiments may use a h ranging from any of a lower limit of any of 0.1H, 0.2H, 0.3H, 0.4H, 0.5H, 0.6H, 0.7H, and 0.8H to an upper limit of any of 0.2H, 0.3H, 0.4H, 0.5H, 0.6H, 0.7H, 0.8H, and 0.9H.

In some embodiments, surface 34*c*" may also be a conic surface that terminates at an apex 34*b*, as illustrated in FIG. 3, instead of a substantially planar surface 24*b*, as illustrated in FIG. 2. In such an embodiment, an angle α between the tangent to the conic surface 34*c*" and the cylindrical surface 34*c*' may be calculated, and may range from 15 to 70 degrees. While apex 34*b* is illustrated as a point, one skilled in the art would appreciate that such apex may include a smooth transition curved so as to be free of sharp edges and/or transitions with radii of at least about 0.005 inches, or at least about 0.020 inches in another embodiment, and up to 0.50 inches in yet another embodiment.

Figure 4A:
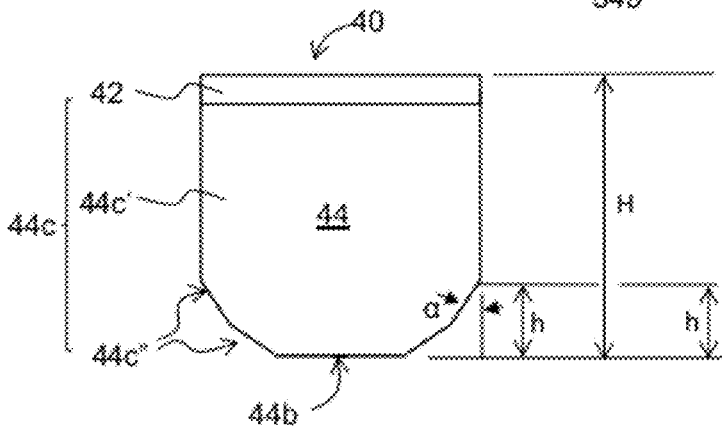
FIGS. 4A and 4B show cutting elements according to embodiments of the present disclosure.
Figure 4B:
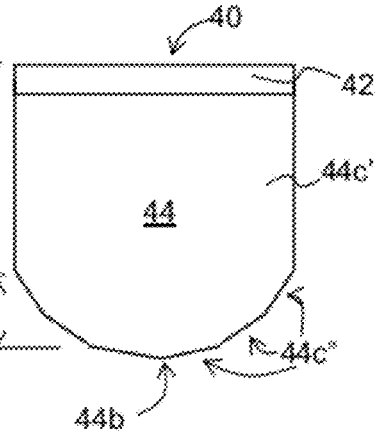

Referring now to FIGS. 4A and 4B, FIGS. 4A and 4B illustrates side views of two embodiments of a cutting element according to the present disclosure. As shown in FIG. 4, a cutting element 40 possesses an ultrahard material layer 42 disposed on a substrate 44. The lowermost surface 44*b* of substrate is shown as being substantially planar in FIG. 4A and as an apex in FIG. 4B. A portion of side surface 44*c* forms a cylindrical surface 44*c*', and a portion of side surface 44*c* forms multiple conic surfaces 44*c*" that extends between cylindrical surface 44*c*' and lower surface 44*b*. In accordance with various embodiments of the present disclosure the plurality of conic surfaces 44*c*" may be of such size that their total height h extends along from about 10 to 90 percent of the total height H of the cutting element 40. Further, in the embodiment illustrated in FIG. 4A the conic surfaces 44*c*" extends from an outer radial position towards a longitudinal axis of the bit such that the lower surface 44*b* possesses a smaller diameter d than the diameter D of the cutting element 40. In various embodiments, d may range from about D/10 to less than D. Other embodiments may use a d ranging from any of a lower limit of any of D/10, D/5, D/4, D/3, D/2, ⅔(D), ¾(D), ⅘(D) to an upper limit of any of D/5, D/4, D/3, D/2, ⅔(D), ¾(D), ⅘(D), and less than D. Further, conic surfaces 24*c*" may form an angle α with cylindrical surface 24*c*', where the angle α is calculated between a surface created between the two end points of the combined conic surfaces 24*c*". In various embodiments, such angle α may range from about 15 degrees to about 70 degrees. Further, transitions between cylindrical surface 44*c*' and conic surface 44*c*", multiple conic surfaces 44*c*", and/or conic surface 44*c*" and lower surface 44*b* may be radiused for a smooth transition, as described above.

Figure 5:
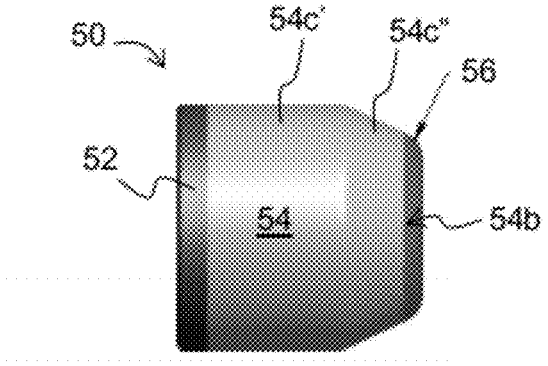
FIG. 5 shows a cutting element according to one embodiment of the present disclosure.

Referring now to FIG. 5, a side view of a cutting element 50 is shown. As shown in FIG. 5, cutting element 50 includes an ultrahard material layer 52 disposed on a substrate 54. The side surfaces of substrate 54 include a cylindrical surface 54*c*' and a conic surface 54*c*", similar to the embodiment illustrated in FIG. 2. However, in the embodiment illustrated in FIG. 5, the lower surface 54*b* of substrate 54 has an ultrahard material layer 56 disposed thereon.

It is within the scope of the present disclosure that the ultrahard material layer 56 disposed on the lower surface 54*b* of substrate 54 may also be included in cutting elements having geometry as illustrated in FIGS. 3, 4A and 4B, where the shape of the ultrahard material layer 56 is of the same type as the lower surface of substrate 54. Alternatively, it also within the scope of the present disclosure that a lower surface of substrate 54 may be substantially planar and the ultrahard material layer 56 may have a non-planar outer surface. Conversely, it is also within the scope of the present disclosure that a lower surface of substrate 54 may be non-planar, i.e., terminating in an apex, and the ultrahard material layer 56 may have a substantially planar outer surface.

Figure 6:
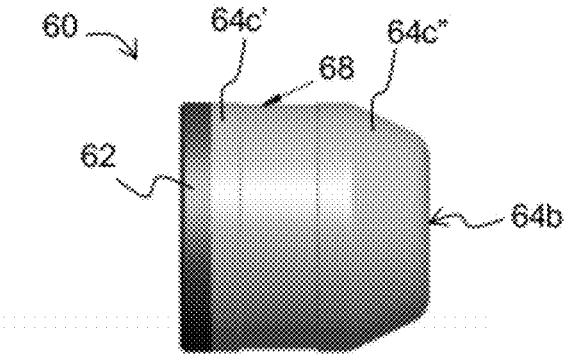
FIG. 6 shows a cutting element according to one embodiment of the present disclosure.

Referring now to FIG. 6, a side view of a cutting element 60 is shown. As shown in FIG. 6, cutting element 60 includes an ultrahard material layer 62 disposed on a substrate 64. The side surfaces of substrate 54 include a cylindrical surface 64*c*' and a conic surface 64*c*", similar to the embodiment illustrated in FIG. 2. However, in the embodiment illustrated in FIG. 6, the cylindrical surface 64*c*' includes a relief groove, i.e., a circumferential groove of reduced diameter, therein. The relief groove 68 may have a reduced diameter ranging from about 0.002" to 0.010" less than the OD of the element in one embodiment, or from about 0.010" to 0.030" less than the OD of the element in another embodiment. It is within the scope of the present disclosure that the relief groove 68 formed in the cylindrical surface 64*c*' may also be included in other the cutting elements described herein.

Figure 7:
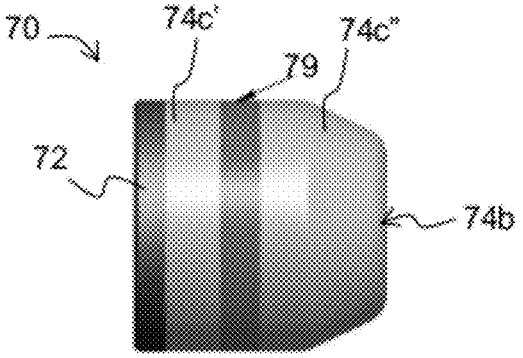
FIG. 7 shows a cutting element according to one embodiment of the present disclosure.

Referring now to FIG. 7, a side view of a cutting element 70 is shown. As shown in FIG. 7, cutting element 70 includes an ultrahard material layer 72 disposed on a substrate 74. The side surfaces of substrate 74 include a cylindrical surface 74*c*' and a conic surface 74*c*", similar to the embodiment illustrated in FIG. 2. However, in the embodiment illustrated in FIG. 7, the cylindrical surface 74*c*' includes an annular band of ultrahard material 79 embedded therein along a portion of the length of cylindrical surface 74*c*'. The annular band of ultrahard material 79 may have a band width along the cylindrical surface ranging from 0.020" to 0.200" in one embodiment, or from 0.020" to 0.040" in another embodiment, and depth into the center ranging from 0.002" to 0.020" in one embodiment, or from 0.002 to 0.010" in another embodiment. It is within the scope of the present disclosure that the annular band of ultrahard material embedded in the cylindrical surface 74*c*' may also be included in other the cutting elements described herein.

Figure 8:
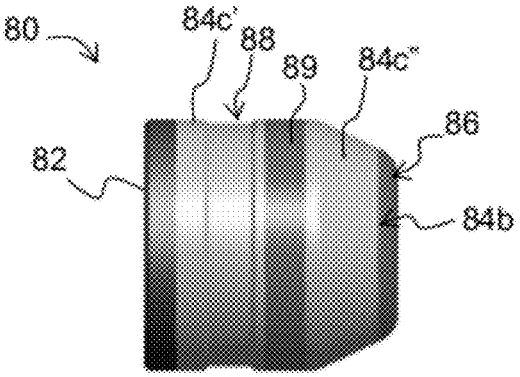
FIG. 8 shows a cutting element according to one embodiment of the present disclosure.

Referring now to FIG. 8, a side view of a cutting element 80 is shown. As shown in FIG. 8, cutting element 80 includes an ultrahard material layer 82 disposed on a substrate 84. The side surfaces of substrate 84 include a cylindrical surface 84*c*' and a conic surface 84*c*", similar to the embodiment illustrated in FIG. 2. However, in the embodiment illustrated in FIG. 8, the cylindrical surface 84*c*' includes a relief groove 88 formed therein, as previously illustrated in FIG. 6, and an annular band of ultrahard material 89 embedded therein, as previously illustrated in FIG. 7, along portions of the length of cylindrical surface 84*c*'. Further, ultrahard material layer 86, as previously illustrated in FIG. 5, is also present in this embodiment, disposed on the lower surface 84*b* of cutting element 80. While FIG. 8 illustrates these three features, ultrahard material layer 86, the relief groove 88, and the annular band of ultrahard material 89, in combination together, it is also within the scope of the present disclosure that any combination of the features may be used. Further, it is within the scope of the present disclosure that any combination of the ultrahard material layer 86, the relief groove 88, and the annular band of ultrahard material 89 may also be included in cutting elements having geometry as illustrated in FIGS. 3, 4A and 4B, Further, as described above, the various embodiment of cutting elements described herein may be used on a drill bit or other cutting tool, where the cutting elements are immovably attached to the drill bit or other cutting tool or where the cutting elements are retained on the drill bit or other cutting tool in such a manner that the cutting element is still capable of rotating about its longitudinal axis.

Figure 1A:
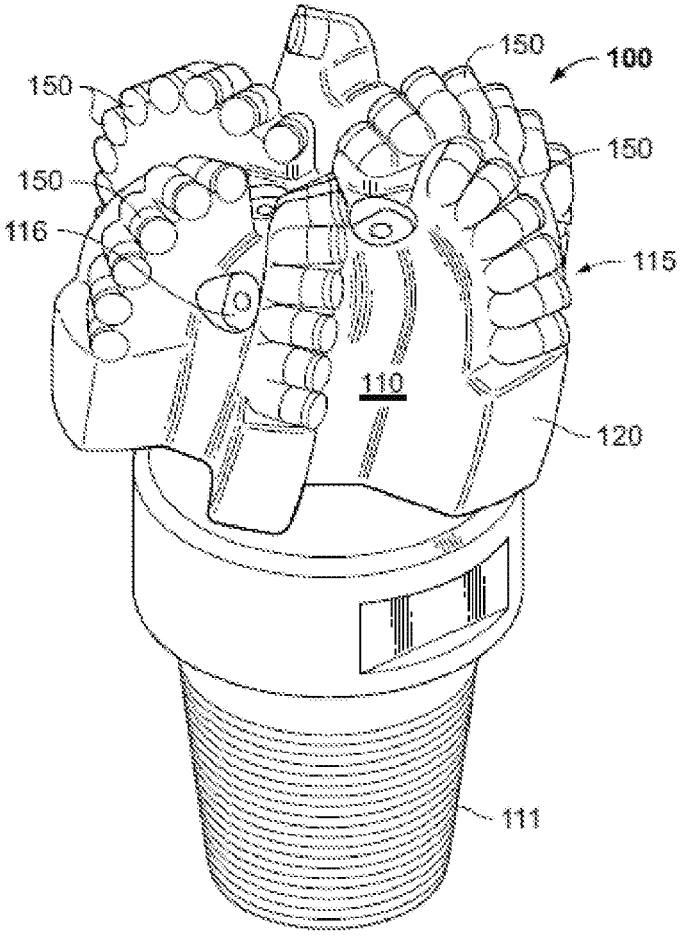
FIG. 1A shows a perspective view of a conventional drag bit and FIG. 1B shows a perspective view of a conventional cutter.
Figure 1B:
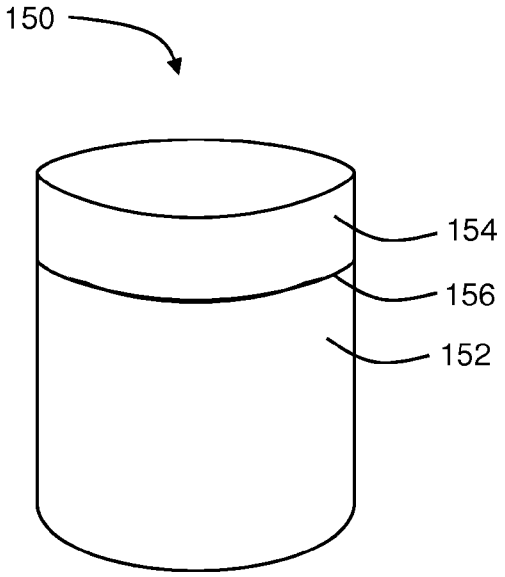
Figure 9:
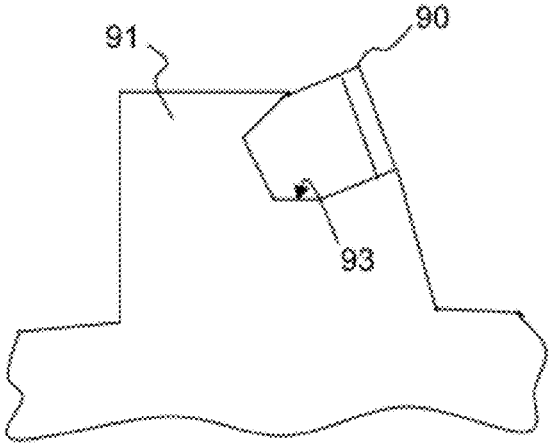
FIG. 9 shows a cutting tool having a cutting element according to one embodiment of the present disclosure.

In the embodiment illustrated in FIG. 9, a cutting tool (not shown) includes a cutting element support structure 91 having at least one cutter pocket 93 formed therein. A cutting element 90 is disposed within the cutter pocket 93, and is immovably attached within the cutter pocket 93. Such attachment may, for example, occur by brazing the cutting element 90 within the cutter pocket using a braze material, but the present disclosure is not so limited. Rather, it is also within the scope of the present disclosure that a cutting element having the geometry described herein may be retained by non-brazing means, including any mechanical attachment means known in the art. In a particular embodiment, the cutting tool may be a drill bit, such as the type of drill bit shown in FIGS. 1A and 1B, where the cutting element support structure is a blade that extends radially from a center of a bit body, and the cutting element 90 is of the type of cutting element illustrated in FIG. 2, 4A, or 5-8, i.e., having a substantially planar lower surface, brazed into cutter pocket 93. In such an embodiment, the cutter pocket 93 may have a substantially mating geometry as the cutting element 90. As used herein, a "substantially mating" geometry for a cutting element to be brazed into the cutter pocket includes a gap between the corresponding surface to be substantially filled by a braze material. Such gap may range, for example, between 0.0015 to 0.005 inches; however, the particular gap may slightly vary, in other embodiments, depending on the size of the bit and cutting elements, for example. A cutter pocket having such corresponding shape may be formed using shaped displacements or a mold having the desired shape. As described above, during a conventional cutter brazing process, cracks or micro-cracks often form in the bit body in the area surrounding the cutter pockets, particularly at the corners of the pockets, and especially when harder matrix materials are used to form the bit body. However, the present inventors found that by using cutting elements (and cutter pockets) having the geometries described herein, a reduction in stresses at the corners of the cutting pockets may be achieved, reducing the initiation and propagation of such cracks in the bit body. The present design may also reduce the amount of flux and/or porosity often found in the corners, which may result in an increased brazing strength and increased retention of cutters.

Figure 10:
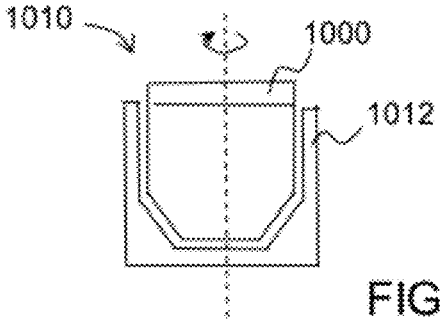
FIG. 10 shows a cutting assembly according to one embodiment of the present disclosure.

In other embodiments, the cutting elements of the present disclosure may be affixed to a tool so that the cutting element is capable of rotating about its longitudinal axis. For example, as shown in FIG. 10, a cutter assembly 1010 may include an inner cutting element 1000 having a geometry of the type described in any one of FIGS. 2-8 above, which is partially surrounded by an outer support element 1012. The type of cutter assembly 1020 and outer support element 1012 is of no limitation to the present disclosure. Further, the type of cutter assembly is of no limitation to the present disclosure. Rather, it may be of any type and/or include any feature such as those described in U.S. Pat. No. 7,703,559, U.S. Patent Application No. 61/351,035 or U.S. patent application Ser. No. 13/456,624 entitled "Methods of Attaching Rolling Cutters in Fixed Cutter Bits using Sleeve, Compression Spring, and/or Pin(s)/Ball(s)" filed concurrently herewith (now U.S. Pat. No. 9,187,962), all of which are assigned to the present assignee and herein incorporated by reference in their entirety. For example, the outer support element 1012 may include components that at least partially cover the upper, side, and/or lower surfaces of the inner rotatable cutting element 1000.

Figure 11:
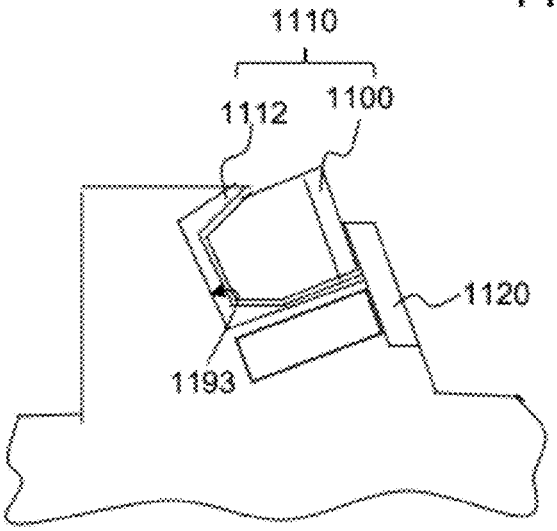
FIG. 11 shows a cutting tool having a cutting element according to one embodiment of the present disclosure.
Figure 12:
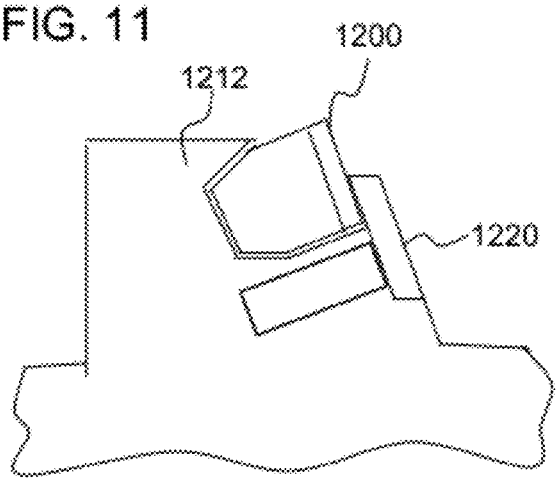
FIG. 12 shows a cutting tool having a cutting element according to one embodiment of the present disclosure.

In some embodiments, the outer support element 1012 may be integral with the cutting tool support structure (i.e., blade extending from a bit body) (not shown in FIG. 10); however, it may be a discrete component separate from the cutting tool support structure in yet other embodiments. In the latter embodiment, as illustrated in FIG. 11, the cutter assembly 1110 having an inner rotatable cutting element 1100 at least partially surrounded by an outer support element 1112 may be brazed or otherwise affixed to a cutter pocket 1193. Alternatively, the cutter assembly may be formed from the cutting tool support structure serving as the outer support element 1212 that engages and at least partially surrounds the inner rotatable cutting element, as illustrated in FIG. 12. One or more surfaces of the outer support element are substantially mating with the inner rotatable cutting element, which to allow for sufficient room for rotation, may include a gap ranging from about 0.003 to 0.030 inches. However, this range may vary on one or more surfaces.

In embodiment using a discrete outer support element 1112, as illustrated in FIG. 11, such component may be placed by any means known in the art, including by casting in place during sintering the bit body (or other cutting tool) or by brazing the element in place in the cutter pocket 1193. Brazing may occur before or after the inner rotatable cutting element 1100 is retained within the outer support element 1112; however, in particular embodiments, the inner rotatable cutting element 1100 is retained in the outer support element after the outer support element is brazed into place.

Figure 13A:
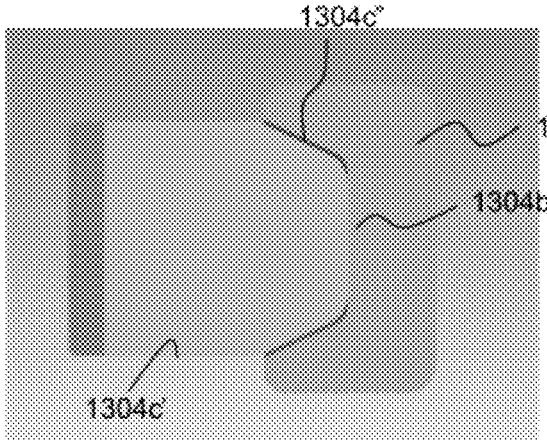
FIGS. 13A, 13B, and 13C show a cutting assembly and cutting tool including the cutting assembly according to one embodiment of the present disclosure.
Figure 13B:
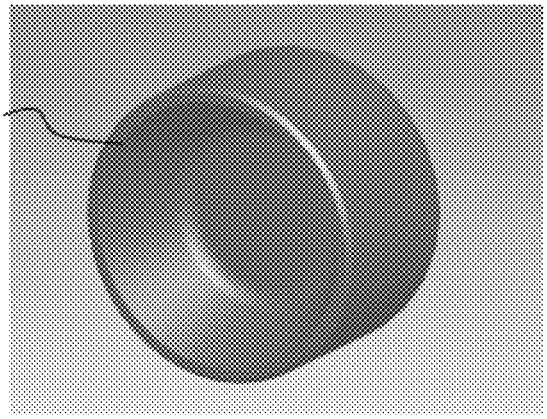
Figure 13C:
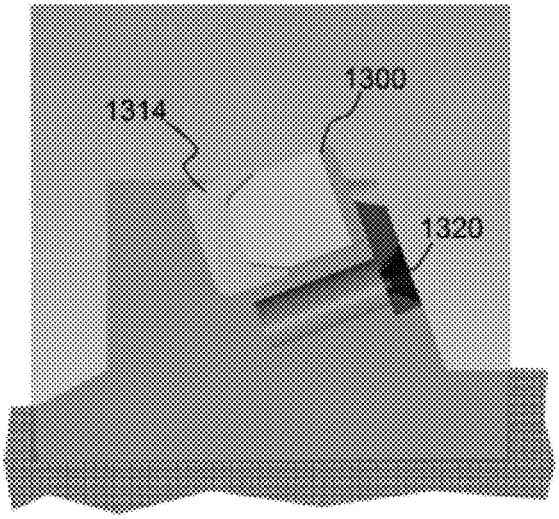
Figure 14A:
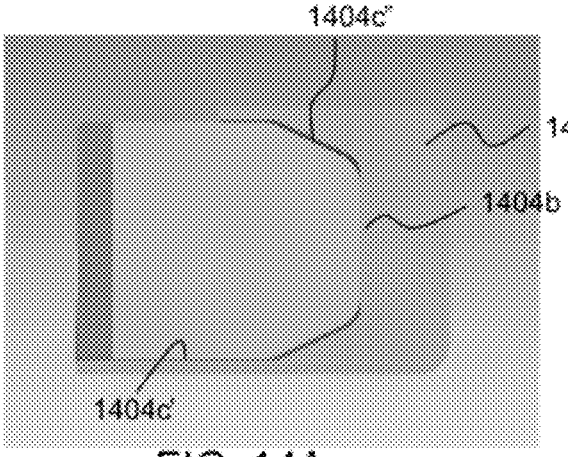
FIGS. 14A, 14B, and 14C show a cutting assembly and cutting tool including the cutting assembly according to one embodiment of the present disclosure.
Figure 14B:
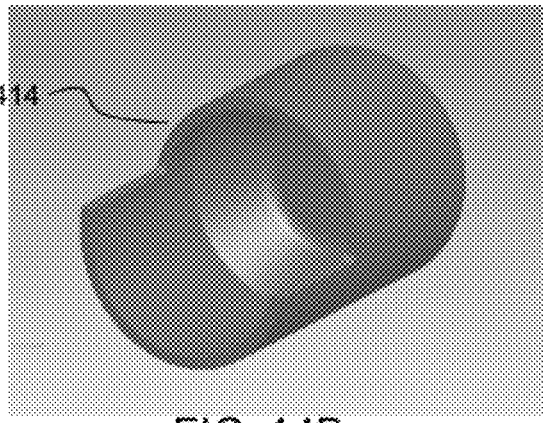
Figure 14C:
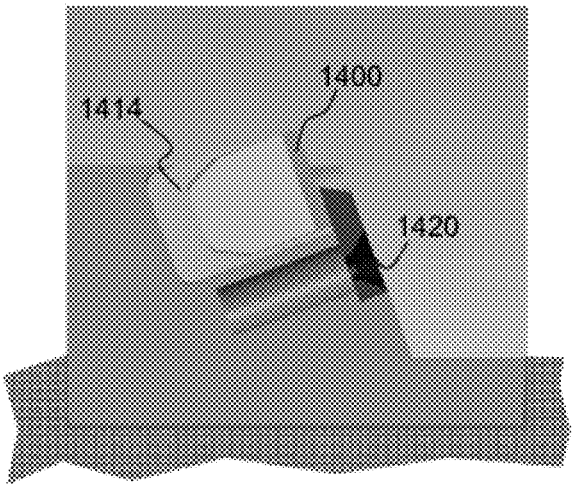
Figure 15A:
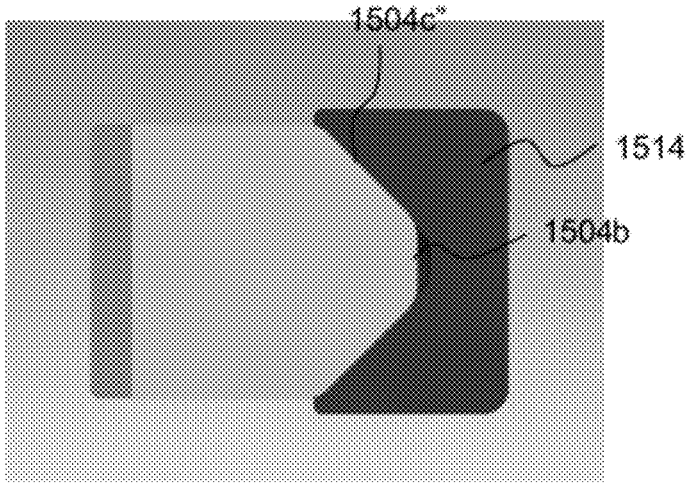
FIGS. 15A and 15B show a cutting assembly and cutting tool including the cutting assembly according to one embodiment of the present disclosure.
Figure 15B:
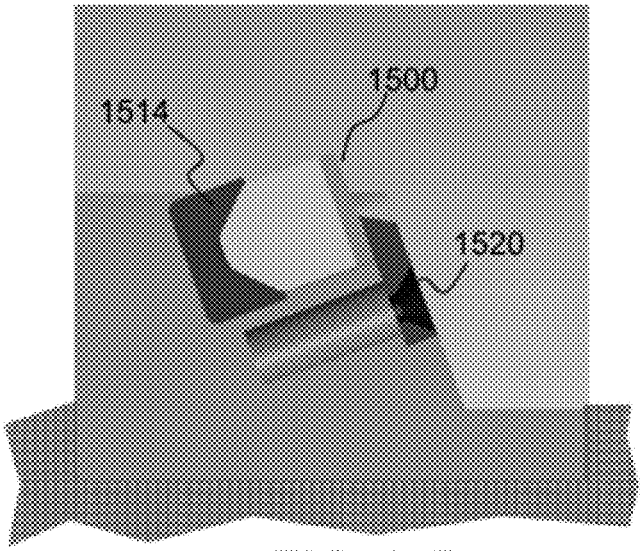
Figure 16:
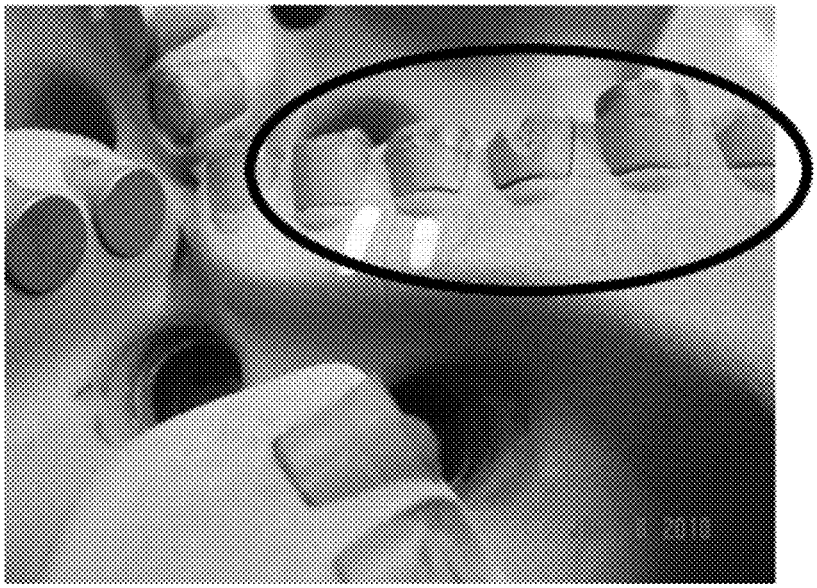
FIG. 16 shows a prior art drill bit.

While inner rotatable cutting elements must be free to rotate about their longitudinal axis, their retention on a cutting tool may be achieved through the shape of the outer support element, generally, which may include one or more discrete components to achieve such retention. Certain components that may particularly provided such retention function may be separately referred to as a retention mechanism. The type of such retention mechanism is no limitation on the present disclosure, but may include retention by covering and/or interacting with an upper surface of the inner rotatable cutting element, a side surface of the inner rotatable cutting element, or a lower surface of the inner rotatable cutting element. In the embodiment shown in FIGS. 11-15, a front retention mechanism 1120, 1220, 1320, 1420, 1520 may be used, such as those described in U.S. Patent Application No. 61/351,035, to partially cover the upper surface of the cutting element. Various embodiments, such as those illustrated in FIGS. 13-15 may also use a back retention mechanism. For example, back retention mechanism 1314 may be a cup that possesses at least one surface that is substantially mating with at least one surface of the inner rotatable cutting element 1300. In the embodiment shown in FIG. 13, the back retention mechanism 1314 has substantially mating surfaces with the conic side surface 1304*c*" and the lower surface 1304*b*. In the embodiment shown in FIG. 14, the back retention mechanism 1414 has substantially mating surfaces with the conic side surface 1404*c*", the lower surface 1404*b*, and a portion of cylindrical side surface 1404*c*'. Further, in the embodiment shown in FIG. 15, back retention mechanism 1514 has substantially mating surfaces with the conic side surface 1504*c*" but not lower surface 1504*b*.

While the illustrated embodiments of cutting elements of the present disclosure installed on a cutting element support structure (i.e., drill bit or other cutting tool) as a rotatable cutting element all show the geometry illustrated in FIG. 2, any of the cutting elements described in FIGS. 2-8 may be configured as a rotatable cutting element installed on a bit with a retention mechanism that allows the rotatable cutting element to rotatable about its longitudinal axis.

Figure 17:
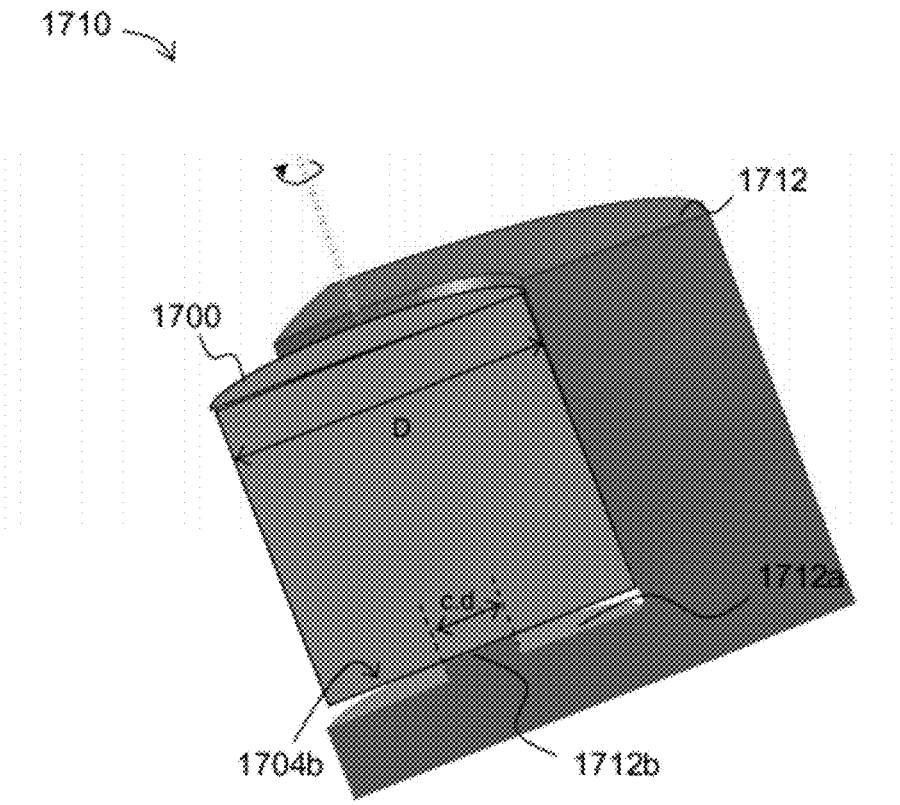
FIG. 17 shows a cutter assembly according to one embodiment of the present disclosure.

Referring now to FIG. 17, a cutter assembly having an inner rotatable cutting element is shown. As shown in FIG. 17, a cutter assembly 1710 may include an inner rotatable cutting element 1700, which is partially surrounded by an outer support element 1712. Outer support element 1712 may have a protrusion 1712*b* (extending a height from about 0.001" to 0.030", and from about 0.005" to 0.010" in a more particular embodiment, from surrounding surface 1712*a*) that contacts inner rotatable cutting element at its lower surface 1704*b* at a contact diameter c.d., which is less than the outer diameter D of the inner rotatable cutting element 1700. In various embodiments, c.d may range from about D/10 to less D, and from about D/10 to less than 4/5(D) in other various embodiments. Other embodiments may use a contact diameter c.d. ranging from any of a lower limit of any of D/10, D/5, D/4, D/3, D/2, 2/3(D), 3/4(D), 4/5(D) to an upper limit of any of D/5, D/4, D/3, D/2, 2/3(D), 3/4(D), and 4/5(D). The reduced contact diameter (in comparison to the outer diameter D) may alternatively (instead of a protrusion from the outer support element) be achieved through the use of conical surfaces, as described, for example in FIGS. 2 and 4.

Figure 18:
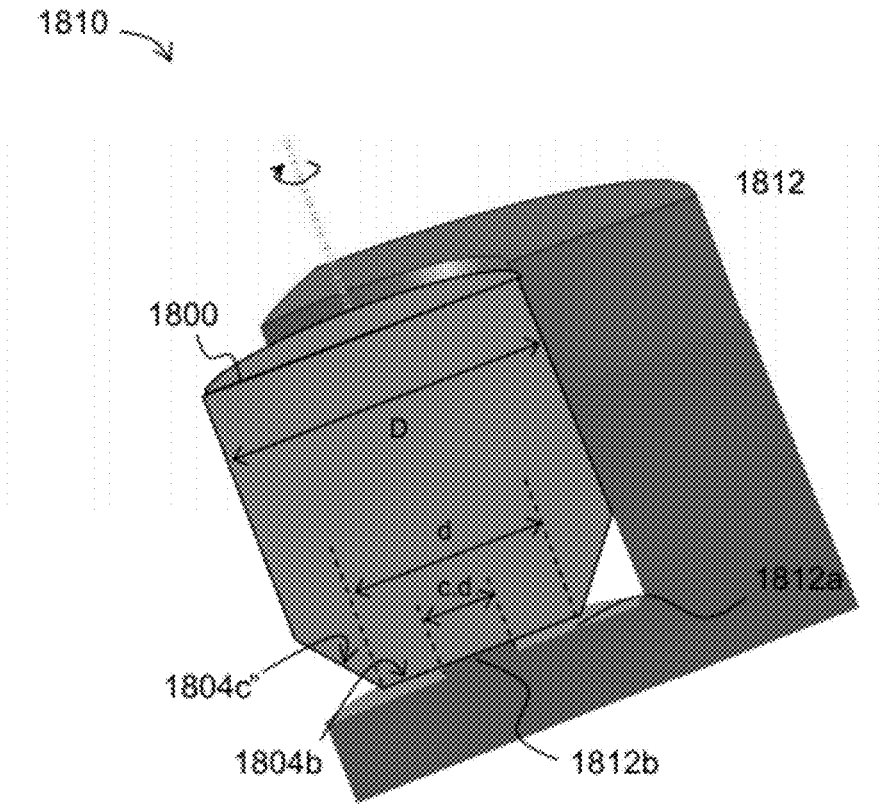
FIG. 18 shows a cutter assembly according to one embodiment of the present disclosure.

Further, it is also within the scope of the present disclosure the outer support element may include such a protrusion in combination with at least one conic surface (such as illustrated in above described embodiments). For example, as illustrated in FIG. 18, a cutter assembly 1810 may include an inner rotatable cutting element 1800, which is partially surrounded by an outer support element 1812. Outer support element 1812 may have a protrusion 1812*b* (extending a height from about 0.001" to 0.030", and from about 0.005" to 0.010" in a more particular embodiment, from surrounding surface 1812*a*) that contacts inner rotatable cutting element at its lower surface 1804*b* at a contact diameter c.d., which is less than the outer diameter D of the inner rotatable cutting element 1800, as well as less than the diameter d of the lower surface 1804*b* of inner rotatable cutting element 1800. The diameter d of lower surface is less than the outer diameter D due to the conic surface 1804*c*" extends from an outer radial position towards a longitudinal axis of the cutting element such that the lower surface 1804*b* possesses a smaller diameter d than outer diameter D, as described above. In various embodiments, the contact diameter c.d. may be less than d and also range from about D/10 to less than 4/5(D). Other embodiments may use a contact diameter c.d. ranging from any of a lower limit of any of D/10, D/5, D/4, D/3, D/2, 2/3(D), 3/4(D), 4/5(D) to an upper limit of any of D/5, D/4, D/3, D/2, 2/3(D), 3/4(D), and 4/5(D), and also be less than the diameter d at the lower surface 1844*b*. Further, as described above with respect to FIG. 10, in both of the embodiments illustrated in FIGS. 17 and 18, cutter assembly 1700, 1800 and outer support element 1712, 1812 is of no limitation to the present disclosure. For example, the outer support element 1712, 1812 may include components that at least partially cover the upper, side, and/or lower surfaces of the inner rotatable cutting element 1700, 1800. In some embodiments, the outer support element 1712, 1818 may be integral with the cutting tool support structure (i.e., blade extending from a bit body) or it may be a discrete component (brazed or otherwise affixed to a cutter pocket) separate from the cutting tool support structure in yet other embodiments. One or more surfaces of the outer support element are substantially mating with the inner rotatable cutting element, which to allow for sufficient room for rotation, may include a gap ranging from about 0.003 to 0.030 inches. However, this range may vary on one or more surfaces (such as the lower surface 1744*b*, 1844*b*). Further, while the inner rotatable cutting element is illustrated as a single body (i.e., a single ultrahard body), it is also within the scope of the present disclosure that an ultrahard material layer may be disposed on a substrate having the illustrated characteristics.

Each of the embodiments described herein have at least one ultrahard material included therein. Such ultra hard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by removing substantially all metal from the interstitial spaces between interconnected diamond particles or from a diamond/silicon carbide composite, or other ultra hard material such as a cubic boron nitride. Further, in particular embodiments, the inner rotatable cutting element may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that forms the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

Alternatively, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is disposed may be formed of a variety of hard or ultra hard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended. In another embodiment, the substrate may also be formed from a diamond ultra hard material such as polycrystalline diamond and thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be preferable to have a single diamond composite forming the cutting face and substrate or distinct layers. Specifically, in embodiments where the cutting element is a rotatable cutting element, the entire cutting element may be formed from an ultrahard material, including thermally stable diamond (formed, for example, by removing metal from the interstitial regions or by forming a diamond/silicon carbide composite).

The outer support element may be formed from a variety of materials. In one embodiment, the outer support element may be formed of a suitable material such as tungsten carbide, tantalum carbide, or titanium carbide. Additionally, various binding metals may be included in the outer support element, such as cobalt, nickel, iron, metal alloys, or mixtures thereof, such that the metal carbide grains are supported within the metallic binder. In a particular embodiment, the outer support element is a cemented tungsten carbide with a cobalt content ranging from 6 to 13 percent. It is also within the scope of the present disclosure that the outer support element (including a back retention mechanism) may also include more lubricious materials to reduce the coefficient of friction. The components may be formed of such materials in their entirely or have portions of the components including such lubricious materials deposited on the component, such as by chemical plating, chemical vapor deposition (CVD) including hollow cathode plasma enhanced CVD, physical vapor deposition, vacuum deposition, arc processes, or high velocity sprays). In a particular embodiment, a diamond-like coating may be deposited through CVD or hallow cathode plasma enhanced CVD, such as the type of coatings disclosed in US 2010/0108403, which is assigned to the present assignee and herein incorporated by reference in its entirety.

In other embodiments, the outer support element may be formed of alloy steels, nickel-based alloys, and cobalt-based alloys. One of ordinary skill in the art would also recognize that cutting element components may be coated with a hardfacing material for increased erosion protection. Such coatings may be applied by various techniques known in the art such as, for example, detonation gun (d-gun) and spray-and-fuse techniques.

The cutting elements of the present disclosure may be incorporated in various types of cutting tools, including for example, as cutters in fixed cutter bits or as inserts in roller cone bits. Bits having the cutting elements of the present disclosure may include a single rotatable cutting element with the remaining cutting elements being conventional cutting elements, all cutting elements being rotatable, or any combination therebetween of rotatable and conventional cutting elements.

In some embodiments, the placement of the cutting elements on the blade of a fixed cutter bit or cone of a roller cone bit may be selected such that the rotatable cutting elements are placed in areas experiencing the greatest wear. For example, in a particular embodiment, rotatable cutting elements may be placed on the shoulder or nose area of a fixed cutter bit. Additionally, one of ordinary skill in the art would recognize that there exists no limitation on the sizes of the cutting elements of the present disclosure. For example, in various embodiments, the cutting elements may be formed in sizes including, but not limited to, 9 mm, 13 mm, 16 mm, and 19 mm.

Further, one of ordinary skill in the art would also appreciate that any of the design modifications as described above, including, for example, side rake, back rake, variations in geometry, surface alteration/etching, seals, bearings, material compositions, etc, may be included in various combinations not limited to those described above in the cutting elements of the present disclosure. In one embodiment, a cutter may have a side rake ranging from 0 to ±45 degrees. In another embodiment, a cutter may have a back rake ranging from about 5 to 35 degrees.

A cutter may be positioned on a blade with a selected back rake to assist in removing drill cuttings and increasing rate of penetration. A cutter disposed on a drill bit with side rake may be forced forward in a radial and tangential direction when the bit rotates. In some embodiments because the radial direction may assist the movement of inner rotatable cutting element relative to outer support element, such rotation may allow greater drill cuttings removal and provide an improved rate of penetration. One of ordinary skill in the art will realize that any back rake and side rake combination may be used with the cutting elements of the present disclosure to enhance rotatability and/or improve drilling efficiency.

As a cutting element contacts formation, the rotating motion of the cutting element may be continuous or discontinuous. For example, when the cutting element is mounted with a determined side rake and/or back rake, the cutting force may be generally pointed in one direction. Providing a directional cutting force may allow the cutting element to have a continuous rotating motion, further enhancing drilling efficiency.

Embodiments of the present disclosure may provide at least one of the following advantages. For cutting elements immovably attached to the tool, as described above, during a conventional cutter brazing process, cracks or microcracks often form in the bit body in the area surrounding the cutter pockets, particularly at the corners of the pockets, and especially when harder matrix materials are used to form the bit body. However, the present inventors found that by using cutting elements (and cutter pockets) having the geometries described herein, a reduction in stresses at the corners of the cutting pockets may be achieved, reducing the initiation and propagation of such cracks in the bit body. The present design may also reduce the amount of flux and/or porosity often found in the corners, which may result in an increased brazing strength.

Further, the use of conic or other shaped cutting ends may allow for improved rotation within the outer support element. Rotatable cutting elements may avoid the high temperatures generated by typical fixed cutters. Because the cutting surface of prior art cutting elements is constantly contacting formation at a fixed spot, a wear flat can quickly form and thus induce frictional heat. The heat may build-up and cause failure of the cutting element due to thermal mis-match between diamond and catalyst, as discussed above. Embodiments in accordance with the present invention may avoid this heat build-up as the edge contacting the formation changes. The lower temperatures at the edge of the cutting elements may decrease fracture potential, thereby extending the functional life of the cutting element. By decreasing the thermal and mechanical load experienced by the cutting surface of the cutting element, cutting element life may be increase, thereby allowing more efficient drilling.

Further, rotation of a rotatable portion of the cutting element may allow a cutting surface to cut formation using the entire outer edge of the cutting surface, rather than the same section of the outer edge, as provided by the prior art. The entire edge of the cutting element may contact the formation, generating more uniform cutting element edge wear, thereby preventing formation of a local wear flat area. Because the edge wear is more uniform, the cutting element may not wear as quickly, thereby having a longer downhole life, and thus increasing the overall efficiency of the drilling operation.

Additionally, because the edge of the cutting element contacting the formation changes as the rotatable cutting portion of the cutting element rotates, the cutting edge may remain sharp. The sharp cutting edge may increase the rate of penetration while drilling formation, thereby increasing the efficiency of the drilling operation. Further, as the rotatable portion of the cutting element rotates, a hydraulic force may be applied to the cutting surface to cool and clean the surface of the cutting element.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A cutting element, comprising:

a substrate; and an ultrahard material layer having an upper surface disposed on an upper surface of the substrate;

wherein at least a portion of the side surface between the upper surface of the substrate and a lower end of the substrate form at least one conic surface, wherein the at least one conic surface extends a height, relative to the total height of the substrate and ultrahard material layer, ranging from about 1:10 to 9:10, wherein the at least one conic surface extends from the lower end of the substrate, wherein the substrate comprises a substantially planar lower surface, and wherein the substantially planar lower surface comprises a second ultrahard material disposed thereon.

2. The cutting element of claim 1, wherein a diameter of the substantially planar lower surface relative to a diameter of the ultrahard material layer ranges from about 1:10 to less than 1.1.

3. The cutting element of claim 1, wherein the at least one conic surface forms an angle with the outermost circumferential surface of the substrate ranging from about 15 to 70 degrees.

4. The cutting element of claim 1, wherein at least a portion of the side surface of the substrate is a cylindrical surface having a relief groove formed therein.

5. The cutting element of claim 1, wherein at least a portion of the side surface of the substrate comprises an annular band of diamond.

6. The cutting element of claim 1, wherein the substrate comprises at least two conic surfaces at the lower end.

7. A cutter assembly, comprising:

an outer support element; and inner rotating cutting element comprising the cutting element of claim 1, a portion of which is disposed in the outer support element.

8. The cutter assembly of claim 7, wherein the outer support element comprises substantially mating surfaces with at least one conic surface.

9. A cutter assembly, comprising:

an outer support element; and an inner rotating cutting element comprising an ultrahard material forming an upper surface at a first end; wherein the inner rotatable cutting element has an outer diameter, and 10 to 90 percent of the inner rotatable cutting element has a smaller diameter than the outer diameter; wherein the inner rotating cutting element comprises an apex at a second end, and wherein at least a portion of a side surface of the inner rotating cutting element comprises an annular band of diamond or is a cylindrical surface having a relief groove therein.

10. The cutter assembly of claim 9, wherein inner rotating cutting element comprises a paraboloidal second end.

11. The cutter assembly of claim 9, wherein the inner rotating cutting element comprises at least one conic surface at the second end.

12. The cutter assembly of claim 9, wherein the inner rotating cutting element consists of polycrystalline diamond.

13. The cutter assembly of claim 12, wherein the polycrystalline diamond is substantially free of metal in its interstitial spaces.

14. The cutter assembly of claim 12, wherein the polycrystalline diamond is formed from a plurality of diamond grades.

15. The cutter assembly of claim 9, wherein the inner rotating element consists of a diamond and silicon carbide composite structure.

16. The cutter assembly of claim 9, wherein the outer support element comprises substantially mating surfaces with a lower end of the inner rotatable cutting element.

17. A downhole cutting tool, comprising:

a cutting element support structure having at least one cutter pocket formed therein;

at least one rotatable cutting element disposed within the at least one cutter pocket, wherein the at least one cutting element comprises:

a substrate; and an ultrahard material layer having an upper surface disposed on an upper surface of the substrate;

wherein at least a portion of the side surface between the upper surface of the substrate and a lower end of the substrate form at least one conic surface, wherein the at least one conic surface extends a height, relative to the total height of the substrate and ultrahard material layer, ranging from about 1:10 to 9:10, wherein the at least one conic surface extends from the lower end of the substrate, and wherein the substrate comprises a substantially planar lower surface; and at least one retaining element configured to retain the rotatable cutting element in the cutter pocket.

18. The downhole cutting tool of claim 17, wherein the cutter pocket comprises substantially mating surfaces with at least one conic surface.

19. The downhole cutting tool of claim 17, wherein the tool comprises a front retaining element and a back retaining element.

20. The downhole cutting tool of claim 19, wherein the back retaining element comprises a cup in which the lower end of the rotatable cutting element sits, wherein the back retaining element comprises substantially mating surfaces with at least the at least one conic surface of the rotatable cutting element.

21. The downhole cutting tool of claim 19, wherein the substantially planar lower surface of the rotatable cutting element is not substantially mating with the back retaining element.

22. The downhole cutting tool of claim 19, wherein the back retaining element comprises a substantially mating surface along a portion of the side surface of the rotatable cutting element.

* * * * *